US007027747B2

(12) United States Patent
Iwasaki et al.

(10) Patent No.: US 7,027,747 B2
(45) Date of Patent: Apr. 11, 2006

(54) METHOD OF AND APPARATUS FOR FORMING IMAGE USING A NON-CONTACT CHARGER

(75) Inventors: Yukiko Iwasaki, Kanagawa (JP); Ken Amemiya, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/630,848

(22) Filed: Jul. 31, 2003

(65) Prior Publication Data

US 2004/0071476 A1 Apr. 15, 2004

(30) Foreign Application Priority Data

Jul. 31, 2002 (JP) ..... 2002-223687

(51) Int. Cl.
*G03G 15/00* (2006.01)
*G03G 15/02* (2006.01)

(52) U.S. Cl. ..... 399/44; 399/50

(58) Field of Classification Search ..... 399/44, 399/50, 97

See application file for complete search history.

(56) References Cited

U.S. PATENT DOCUMENTS

| | | | | |
|---|---|---|---|---|
| 5,619,316 | A | | 4/1997 | Shoji et al. |
| 5,749,022 | A | * | 5/1998 | Kikui et al. ..... 399/50 |
| 5,887,224 | A | | 3/1999 | Mizuishi et al. |
| 5,915,143 | A | | 6/1999 | Watanabe et al. |
| 6,006,050 | A | | 12/1999 | Watanabe et al. |
| 6,014,532 | A | | 1/2000 | Takeichi et al. |
| 6,055,388 | A | | 4/2000 | Watanabe et al. |
| 6,085,062 | A | | 7/2000 | Mizuishi et al. |
| 6,118,964 | A | | 9/2000 | Kojima et al. |
| 6,128,449 | A | | 10/2000 | Zenba et al. |
| 6,144,811 | A | | 11/2000 | Ohori et al. |
| 6,144,822 | A | | 11/2000 | Yamaguchi et al. |
| 6,148,161 | A | | 11/2000 | Usui et al. |
| 6,160,969 | A | | 12/2000 | Ishigaki et al. |
| 6,266,501 | B1 | | 7/2001 | Mizuishi et al. |
| 6,360,065 | B1 | | 3/2002 | Ishibashi et al. |
| 6,470,161 | B1 | | 10/2002 | Fujishiro et al. |
| 6,505,022 | B1 | | 1/2003 | Kosuge et al. |
| 6,546,219 | B1 | | 4/2003 | Sato et al. |
| 6,628,903 | B1 | | 9/2003 | Ohori et al. |
| 6,628,912 | B1 | | 9/2003 | Amemiya et al. |

FOREIGN PATENT DOCUMENTS

| | | | | |
|---|---|---|---|---|
| JP | 3-240076 | | | 10/1991 |
| JP | 04-246666 | | | 9/1992 |
| JP | 05181350 | A | * | 7/1993 |
| JP | 08123152 | A | * | 5/1996 |
| JP | 9-120199 | | | 5/1997 |
| JP | 10198129 | A | * | 7/1998 |
| JP | 3154628 | | | 4/2001 |
| JP | 2001154462 | A | * | 6/2001 |
| JP | 2001-194957 | | | 7/2001 |
| JP | 2002-072593 | | | 3/2002 |

* cited by examiner

*Primary Examiner*—Arthur T. Grimley
*Assistant Examiner*—Ryan Gleitz
(74) *Attorney, Agent, or Firm*—Oblon, Spivak, McClelland, Maier & Neustadt, P.C.

(57) ABSTRACT

A charger charges a body with a voltage in which an AC voltage is superimposed on a DC voltage. The charger and the body have a small gap therebetween. A sensor measures a humidity in the gap between the charger and the body. A magnitude of the AC voltage to be superimposed on the DC voltage is determined based on the humidity detected.

26 Claims, 4 Drawing Sheets

METHOD OF AND APPARATUS FOR FORMING IMAGE USING A NON-CONTACT CHARGER

BACKGROUND OF THE INVENTION

1) Field of the Invention

The present invention relates to a technology in which there is a gap between a latent image carrier and a charger, which charges the latent image carrier.

2) Description of the Related Art

In an image forming apparatus like a copying machine, a printer, a facsimile, a printing machine etc., an electrostatic latent image is formed on the latent image carrier according to information from a stepper, a host computer etc. The electrostatic latent image is then visualized and the visualized image is transferred to a recording medium like a paper. The image is then fixed and output as either as a copy or an original.

A surface of a photosensitive layer of the latent image carrier is uniformly charged with a charger, which is generally a roller (hereinafter, "charging roller"), before forming the electrostatic latent image. Two charging methods are known; non-contact charging and contact charging. In the non-contact charging, the charging roller does not make a physical contact with the latent image carrier. The non-contact charging is also called corona charging.

On the other hand, in the contact charging, a charging roller makes a physical contact with the latent image carrier. In the non-contact charging, a minute gap is set between the latent image carrier and the charging roller and a discharge is caused to occur in the minute gap. For example, Japanese Patent Application Laid Open Publication No. 1991-240076 discloses the non-contact charging.

The contact charging has an advantage over the non-contact charging in that less quantity of ozone gas is generated in the charging process. However, in the contact charging, since the charging roller touches the latent image carrier, residual toner, paper dust etc. easily gets stuck to the charging roller and causes uneven charging of the latent image carrier. Uneven charging of the latent image carrier leads to degraded image. In this respect the non-contact charging in preferable over the contact charging.

Two methods are widely used to apply a charging bias to the charging roller, whether it be the contact charging or the non-contact charging; AC-application method and DC-application method. In the DC-application method, a DC voltage, which is constant voltage controlled, is applied to the charging roller. In the AC-application method, an AC voltage, which is constant voltage controlled, is superimposed on a DC voltage, which is constant voltage controlled, and the resultant voltage is applied to the charging roller.

The charging bias applied to the charging roller varies depending on the physical properties, for example, the surface resistance, of the charging roller. The physical properties of the charging roller change with the environmental conditions, for example, humidity, temperature, around the charging roller. Japanese Patent Publication Nos. 3154628, 1997-120199 disclose changing the charging bias applied to the charging roller depending on the environmental conditions around the charging roller.

The non-contact charging has a typical problem that the width of the gap between the charging roller and the latent image carrier changes with the environmental conditions around the gap. The change in the width of the gap is due to expansion or reduction of the charging roller, the latent image carrier, or a spacer, used to maintain the gap, due to a change in the humidity or the temperature around the gap. The change in the gap is difficult to deal with because the charging roller, the latent image carrier, and the spacer expand or reduce differently at different locations. If the width of the gap at different locations is different, the charging becomes uneven and that degrades the quality of the image.

SUMMARY OF THE INVENTION

It is an object of the present invention to solve at least the problems in the conventional technology.

According to one aspect of the present invention, a charger charges a body with a voltage in which an AC voltage is superimposed on a DC voltage. The charger and the body have a small gap therebetween. A sensor measures a humidity in the gap between the charger and the body. A magnitude of the AC voltage to be superimposed on the DC voltage is determined based on the humidity detected.

According to another aspect of the present invention, a charger charges a body with a voltage in which an AC voltage is superimposed on a DC voltage. The charger and the body have a small gap therebetween. A sensor measures a humidity and a temperature in the gap between the charger and the body. A magnitude of the AC voltage to be superimposed on the DC voltage is determined based on at least one of the humidity and the temperature detected.

The other objects, features and advantages of the present invention are specifically set forth in or will become apparent from the following detailed descriptions of the invention when read in conjunction with the accompanying drawings.

DETAILED DESCRIPTION

Exemplary embodiments of the image forming method and image forming apparatus according to the present invention are explained below while referring to the accompanying diagrams.

Figure 1:
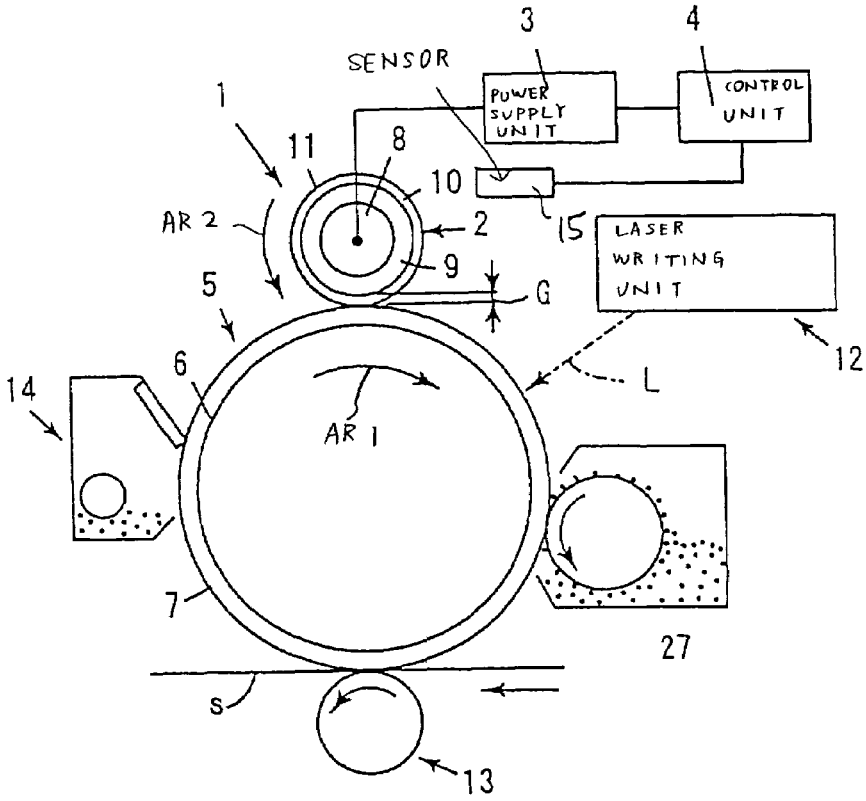
FIG. 1 is a schematic of an image forming apparatus according to an embodiment of the present invention.

FIG. 1 is a schematic of an image forming apparatus according to an embodiment of the present invention. This image forming apparatus may be a copying machine, a printer, a facsimile, or a multifunction device. A multifunction device is the one that includes two or more selected from a group consisting of copying machine, a printer, and a facsimile.

The image forming apparatus includes an image carrier 5. The image carrier 5 includes a substrate 6, which is drum-shaped, and a photosensitive layer 7 on the surface of the substrate 6. The image carrier 5 rotates in a direction of the arrow AR1.

A charging unit 1 uniformly charges the photosensitive layer 7 of the image carrier 5. The charging unit 1 includes a roller-shaped charger 2. There is a gap G between the image carrier 5 and the charging unit 1.

The charger 2 includes a core 8. The core 8 is made of electrically conductive material. A layer 9 is provided on the surface of the core 8. The layer 9 is made of, for example, material having elastic and electrically resistive material, like rubber. The layer 9 may be made of hard material, like resin. A thin layer 10 made of highly electrically resistive material may be formed on the surface of the layer 9.

The charger 2 is interlocked with the image carrier 5 so as to rotate in the direction of an arrow AR2 with the image carrier 5. The charger 2 and the image carrier 5 may be driven with a single driving means or separate driving means. When the charger 2 and the image carrier 5 are driven with a single driving means, spacers 11 (see FIG. 2) provided at the ends of the charger 2 convey the driving force from the charger 2 to the image carrier 5 or vice-versa.

Figure 2:
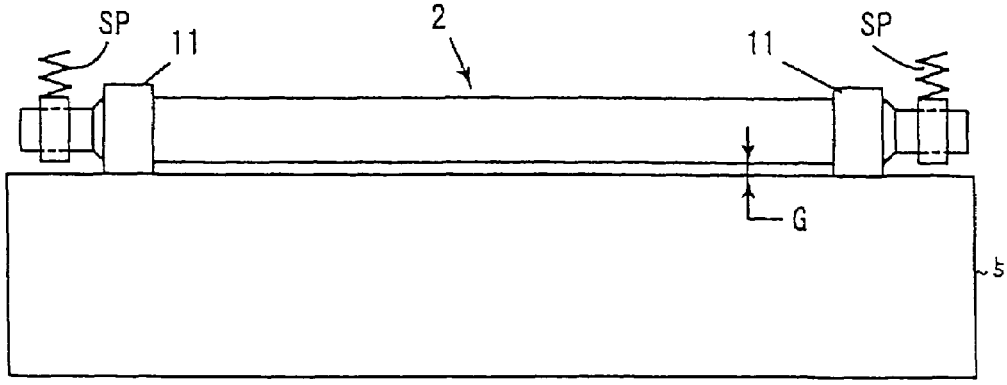
FIG. 2 is a front view of a charger shown in FIG. 1.

FIG. 2 is a front view of the charger 2 and the image carrier 5. The spacers 11 maintain the gap G between the charger 2 and the image carrier 5. The spacers 11 are essentially made of a ring-shaped resin film. The resin film is stuck to the outer surface of the charger 2 with adhesive. Total thickness of the resin film and the adhesive is about 60 μm. The charger 2, and therefore the spacers 11, is pressed towards the image carrier 5 by a spring SP.

A power supply unit 3 applies voltage of about −750 volts to the core 8 of the charger 2 under the control of a control unit (for example, a CPU) 4. As a result, an electric discharge is generated in the gap G. This electric discharge charges the photosensitive layer on the image carrier 5 to a prescribed polarity.

A writing unit 12 forms an electrostatic latent image on the charged image carrier 5 based on image data. The writing unit 12, for example, irradiates laser light L to form the electrostatic latent image. An electric potential of the portion of the image carrier 5 on which the laser light L is irradiated falls as compared to the portion on which the laser light L is not irradiated. As a result, the portion of the image carrier 5 on which the laser light L is irradiated becomes an image and the other portion becomes a non-image.

The electrostatic latent image on the image carrier 5 is then visualized. A developing unit 27 carries out this visualization by spraying a negatively charged toner on the image carrier 5. A transfer unit 13, which is roller, transfers the visualized image on the image carrier 5 to a recording medium S. A cleaning unit 14 cleans the image carrier 5 and removes the toner remained on the image carrier 5.

A voltage in which AC voltage is superimposed on DC voltage is applied to core 8 of the charger 2. The AC voltage and the DC voltage are constant voltage controlled. Precisely, a peak-to-peak voltage of the AC voltage is constant voltage controlled. As a result, a uniform electric potential is generated in the gap G irrespective of a variation in the width of the gap G.

Figure 3:
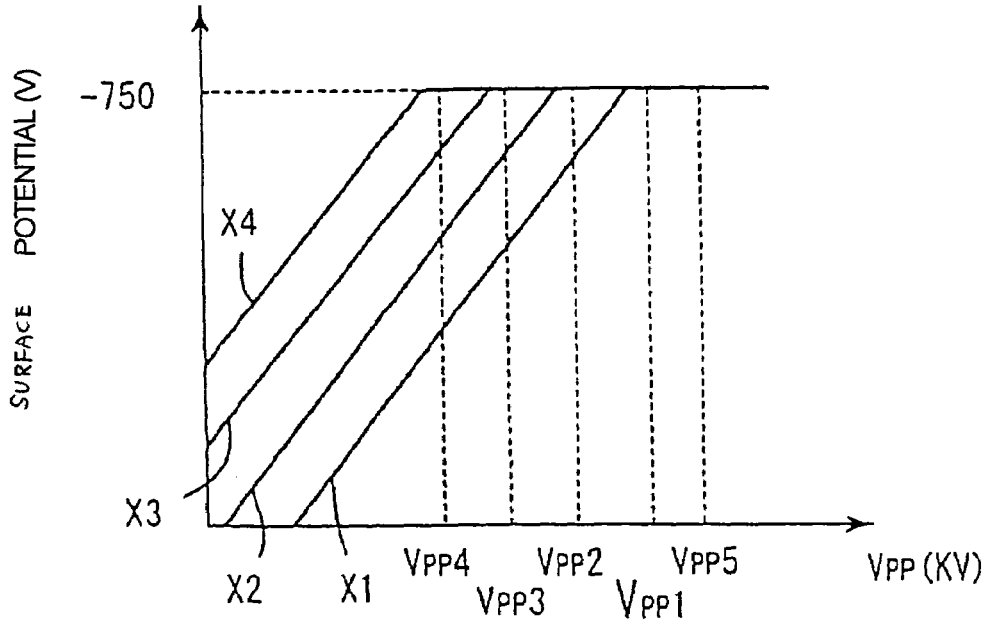
FIG. 3 is a graph of a peak-to-peak voltage of the charger against a potential on a surface of a latent image carrier.

Consider, for example, that an AC voltage of which the peak-to-peak voltage is constant voltage controlled is superimposed on a DC voltage of −750 volts and the resultant voltage is applied to the core 8. FIG. 3 is a graph of the peak-to-peak voltage Vpp and a surface potential of the image carrier 5. The curves X1, X2, X3, and X4 correspond to cases when the width of the gap G is 80 μm, 60 μm, 40 μm, and zero, respectively. It is assumed here that the frequency of the AC voltage is constant.

It can be seen from the graph in FIG. 3 that, when the peak-to-peak voltage Vpp is greater than a certain value, the surface potential of the image carrier 5 is almost constant and does not depend on the width of the gap G. Moreover, the surface potential is almost same as the DC voltage (that is, −750 volts) applied to the core 8.

For example, when the width of the gap G is 80 μm, an electric potential of −750 volt is generated on the surface of the image carrier 5 if the peak-to-peak voltage increases to a value little higher than Vpp1. Similarly, when the width of the gap G is 60 μm, 40 μm, and zero, an electric potential of −750 volt is generated on the surface of the image carrier 5 if peak-to-peak voltages increase to values little higher than Vpp2, Vpp3, and Vpp4, respectively. The values of Vpp1, Vpp2, Vpp3, and Vpp4 can be easily obtained by experiments.

Thus, there is no effect of the width of the gap G on the surface potential of the image carrier 5 if the peak-to-peak voltage is such that the surface potential of the image carrier 5 is equal to the DC voltage. For example, in an image forming apparatus in which the width of the gap G is 80 μm, if an AC voltage in which the peak-to-peak voltage is higher than Vpp1 is superimposed on a DC voltage and the resultant voltage is appiled to the core 8, then the image carrier will be charged with a constant surface potential (equal to the DC voltage) even if there are small variations in the width of the gap G.

Similarly, in an image forming apparatus in which the width of the gap G is 60 μm, if an AC voltage in which the peak-to-peak voltage is higher than Vpp2 is superimposed on a DC voltage and the resultant voltage is appiled to the core 8, then the image carrier will be charged with a constant surface potential (equal to the DC voltage) even if there are small variations in the width of the gap G. Similarly, in an image forming apparatus in which the width of the gap G is 40 μm, if an AC voltage in which the peak-to-peak voltage is higher than Vpp3 is superimposed on a DC voltage and the resultant voltage is appiled to the core 8, then the image carrier will be charged with a constant surface potential (equal to the DC voltage) even if there are small variations in the width of the gap G. And, in an image forming apparatus in which there is almost no gap between the image carrier and the charger, if an AC voltage in which the peak-to-peak voltage is higher than Vpp4 is superimposed on a DC voltage and the resultant voltage is appiled to the core 8, then the image carrier will be charged with a constant surface potential (equal to the DC voltage) even if a small gap is generated between the image carrier and the charger.

Thus, if the voltage is applied to the core 8 in this manner, since the image carrier 5 can be charged with a uniform surface potential irrespective of the width of the gap G between the image carrier and the charger 2, the image quality does not change even if the width of the gap G varies.

Moreover, in the present invention the AC voltage to be superimposed on the DC voltage is constant voltage controlled rather than constant current controlled. The constant current control of the voltage is not preferable because, output of the power pack becomes unstable as the output voltage is varied according to the variation in the gap. This tends to give rise to a defective image, which is a problem peculiar to the non-contact charging.

It should be noted that, a voltage Vpp5 (see FIG. 3), which is higher than Vpp1, may be applied to the core 8 to obtain the same results. However, since the image quality degrades as the voltage becomes high, it is desirable that minimum required voltage is applied.

As already mentioned above, the width of the gap G changes as the environmental conditions around the gap change. For example, the width of the gap G changes as the charger 2 or the image carrier 5 expands or contracts due to changes in an ambient temperature or a humidity in the gap G.

When there is a variation in the gap G, the value of the peak-to-peak voltage that is set based on results in FIG. 3, differs from the value that is in accordance with the variation in the gap G. This results in application of excessively high or low voltages, which gives rise to uneven charging.

Table 1 illustrates the experimental results about the width of the gap G against environmental conditions around the gap G. The absolute humidity was calculated from the temperature and the relative humidity.

TABLE 1

| Temperature (° C.) | Humidity (RH %) | Absolute humidity | Width of Gap (μm) |
|---|---|---|---|
| 9.3 | 12 | 1.07 | 44.8 |
| 19.7 | 10 | 1.7 | 43.8 |
| 29.6 | 11 | 3.27 | 39.6 |
| 29 | 40 | 11.5 | 35.2 |
| 19.7 | 42 | 7.13 | 37.6 |
| 9.8 | 40 | 3.7 | 41.2 |
| 9.7 | 20 | 1.84 | 42.8 |

Figure 4:
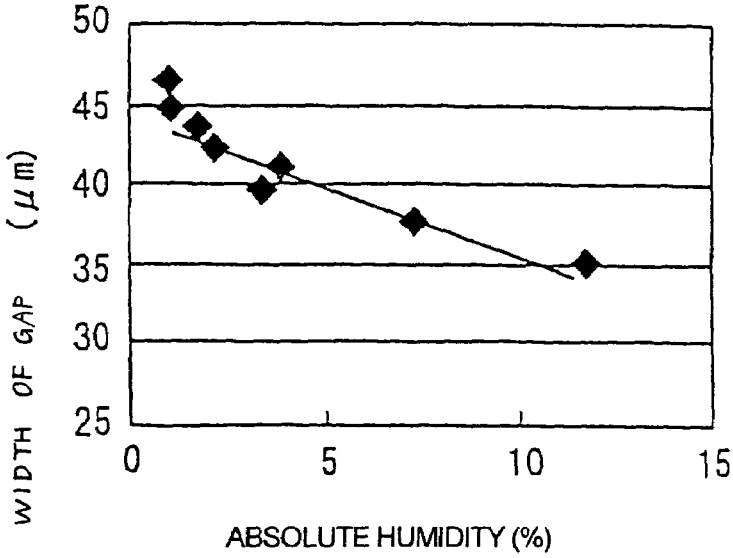
FIG. 4 is a graph of absolute humidity around a gap between the charger and the latent image carrier against width of the gap.

FIG. 4 is a graph of width of the gap G against the absolute humidity. The gap G becomes narrower as the absolute humidity increases. In other words, if the AC voltage to be applied to the core is adjusted based on the absolute humidity around the gap G, then an effect of change in the width of the gap due to change in the absolute humidity on the surface charge of the image carrier can be eliminated.

Referring to FIG. 1, a sensor 15 measures the environmental conditions, for example, the ambient temperature and the humidity, around the gap G, and passes the data to the control unit 4. The control unit 4 calculates the absolute humidity from the temperature and relative humidity and controls the power supply unit 3 based on the result of the calculation.

Table 2 indicates results of the measurement of lower limit peak-to-peak voltage Vpp at which an image with defective discharge was formed due to insufficient AC voltage (insufficient AC bias voltage) in various environments caused by combination of a charging roller and an image carrier. A graph plotted with the absolute humidity on the horizontal axis, indicates a relationship as in FIG. 5.

TABLE 2

| Temperature outside the apparatus (° C.) | Humidity outside the apparatus (° C.) | Temperature inside the apparatus (° C.) | Humidity inside the apparatus (° C.) | Absolute humidity (%) | Vpp (KV) |
|---|---|---|---|---|---|
| 10 | 15 | 14 | 20 | 2.42 | 2.35 |
| 15 | 30 | 19 | 30 | 5.19 | 2.09 |
| 27 | 15 | 30 | 18 | 5.48 | 1.88 |
| 20 | 30 | 24 | 33 | 7.18 | 1.97 |
| 10 | 80 | 14 | 75 | 9.06 | 2.00 |

TABLE 2-continued

| Temperature outside the apparatus (° C.) | Humidity outside the apparatus (° C.) | Temperature inside the apparatus (° C.) | Humidity inside the apparatus (° C.) | Absolute humidity (%) | Vpp (KV) |
|---|---|---|---|---|---|
| 15 | 80 | 20 | 76 | 12.39 | 1.88 |
| 25 | 70 | 27 | 68 | 17.5 | 1.76 |
| 32 | 55 | 34 | 52 | 19.54 | 1.76 |
| 27 | 80 | 30 | 78 | 23.67 | 1.74 |

An excess AC voltage is to be avoided to avoid occurrence of filming phenomenon. To avoid the excess AC voltage, it is necessary to apply voltage higher than lower limit peak-to-peak voltage Vpp and peak-to-peak voltage Vpp as close to the lower limit peak-to-peak voltage. The control unit 4 sets the peak-to-peak voltage Vpp in accordance with the absolute humidity, and the power supply unit 3 applies that voltage to the core 8 of the charger.

Figure 5:
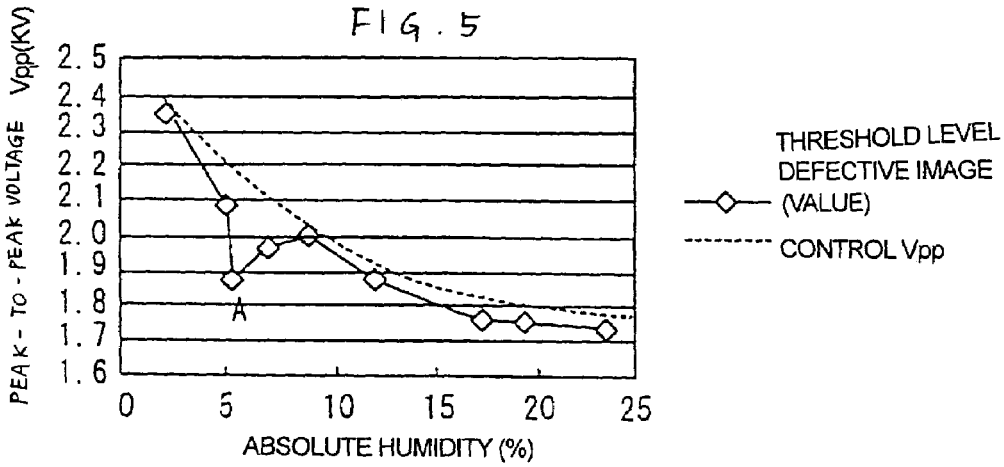
FIG. 5 is a graph of absolute humidity around the gap against the peak-to-peak voltage.

In an experiment, the inventor of the present invention set the peak-to-peak voltage as indicated by a dotted line in FIG. 5 for each of the absolute humidity and observed images on the surface of the image carrier 5 after passing 20,000 papers. The charging was found to be ideal without occurrence of filming and defective discharge on the image. However, some filming was observed on the photoreceptor.

It is desirable to change the peak-to-peak voltage when there is a change in the environment. However, if the peak-to-peak voltage is changed abruptly, the image carrier is charged unevenly and the image quality degrades.

In the present embodiment, the bias change takes place during charging of the area corresponding to the non-image area on the image carrier. That is, when the image forming is continued, there is a rise in temperature inside the apparatus during passing of a paper and variation in the absolute humidity. A bias change of AC voltage according to the variation in the absolute humidity is necessary. Timing for bias change is a time between the passing of two papers. In other words, bias change is carried out during charging of a position that corresponds to the image forming position except the position of the paper passing section.

Experimental results produced a satisfactory image without any horizontal lines after setting the time between passing of two papers for 200 hundred papers as time for bias change.

Thus, when a correction control is carried out for a set of prescribed number of papers, it is possible to apply a suitable bias all the time. Moreover, it is possible to apply suitable bias according to variations in the charging unit, which cannot be detected only by temperature and humidity detecting unit. For example, it is possible to apply suitable bias even in case of a rise in resistance of a roller due to visible contamination of the roller.

However, the curve of the peak-to-peak voltage Vpp shown in FIG. has an irregularity at point A. This irregularity occurred due to environment having high temperature and low humidity (see Table 2).

An electric resistance of the charger 2, which is made of rubber having low resistance, varies with the temperature. Especially, at low temperature, the electric resistance tends to vary considerably.

Figure 6:
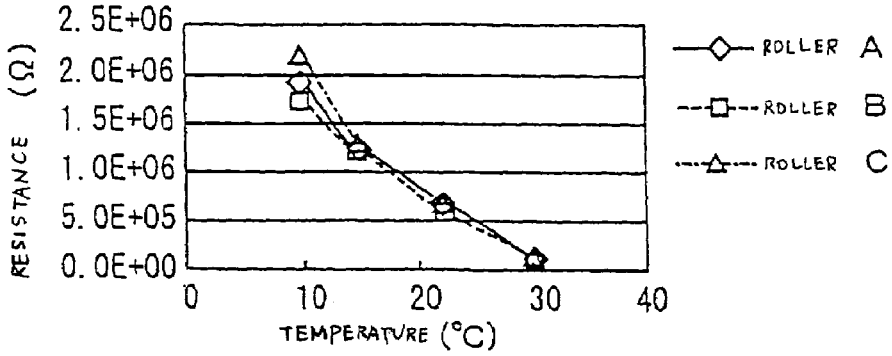
FIG. 6 is a graph of temperature around the gap against a resistance of the charger.

The relationship between the temperature and the resistance that is illustrated in FIG. 6 is known. As a result of this relationship, if the peak-to-peak voltage Vpp is set such that there is no defective charging even in a low temperature high moisture environment, there is a tendency that bias of AC voltage becomes excessive in a high temperature low moisture environment of the absolute moisture rather than the low temperature high moisture environment. This means that it is desirable to carry out correction corresponding to the temperature and along with the correction corresponding to the absolute humidity.

Figure 7:
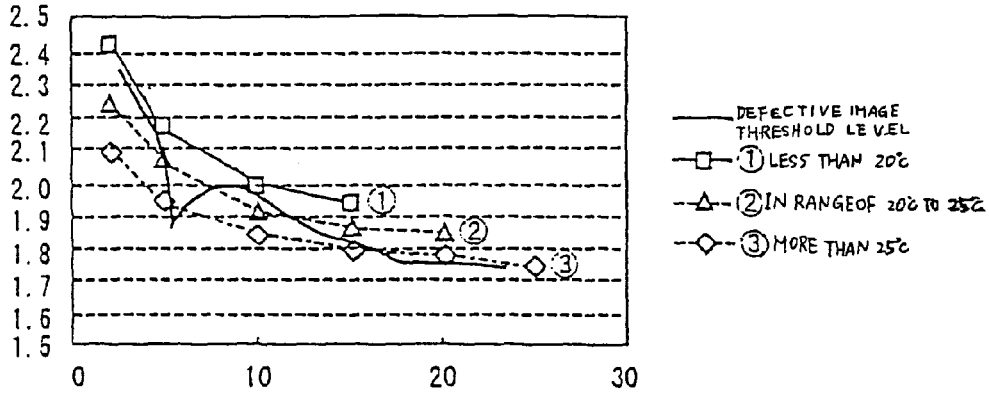
FIG. 7 is a graph of absolute humidity around the gap against the peak-to-peak voltage, when both the absolute humidity and the temperature are considered.

In the image forming apparatus according to the present embodiment, as indicated in FIG. 7, correction corresponding to the temperature is performed based on whether 1) the temperature is less than 20° C., 2) the temperature is in the range of 20° C. to 25° C., and 3) the temperature is above 25° C., in addition to the correction corresponding to the absolute humidity.

In an experiment, 20,000 papers were passed through the image forming apparatus, in the same manner as explained in connection with the explanation of FIG. 5, and satisfactory charging without occurrence of filming of the photoreceptor was achieved.

It is explained above that the correction corresponding to the temperature is performed depending upon three temperature conditions. However, the correction corresponding to the temperature may be performed depending upon more than three temperature conditions. Correction that is more precise can be performed if the temperature conditions are more.

In the present embodiment, when correction of bias conditions is carried out in accordance with the absolute humidity and temperature, a mechanical error between the charger 2 and the image carrier 5 is also taken into consideration. The combination of roller that is used as a charger and the image carrier 5 is same for a particular lot of image forming apparatuses that is manufactured but it varies from lot to lot. Due to the variation, thickness of the spacers 11 which is used for setting either of the resistance of the charging roller and the minute gap, is not uniform in all lots. Therefore, if there is a variation in either of the resistance value and the thickness, the relationship between the absolute humidity and the maximum gap that is illustrated graphically in FIG. 4 is not uniform for all image forming apparatuses.

Figure 8:
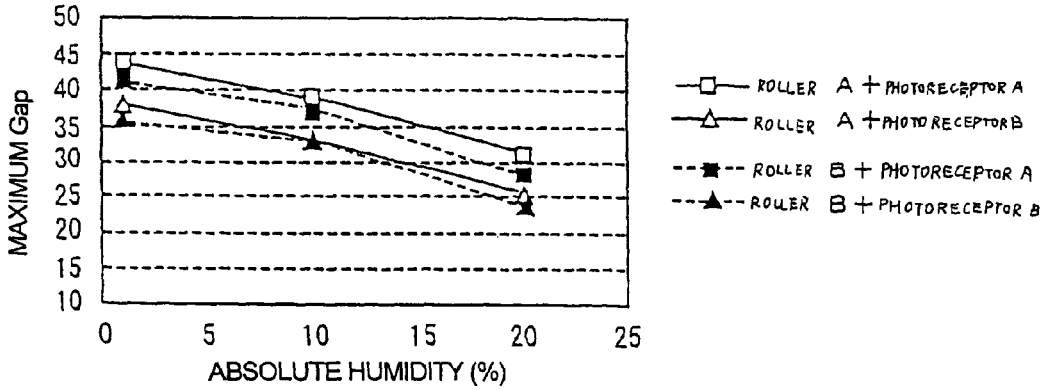
FIG. 8 is a graph of absolute humidity around the gap against maximum width of the gap, for various chargers and latent image carriers.

FIG. 8 is a graph of the absolute humidity against the maximum width of the gap under same conditions as in FIG. 4. As it is seen in FIG. 4, there is some variation in the relationship due to characteristics of material that is used.

For this reason, it is not possible to use the relationship indicated in FIG. 4 as a standard for correction of AC voltage in all image forming apparatuses as a common item. When the variation in each lot is such that it cannot be neglected, it is necessary to assess a characteristic value for each apparatus, to find out the relationship illustrated in FIG. 8, and based on this to carry out correction control of AC voltage according to the relationship indicated in either of FIGS. 5 and 7. However, this sort of measures takes lot of time and hence not practical.

Figure 9:
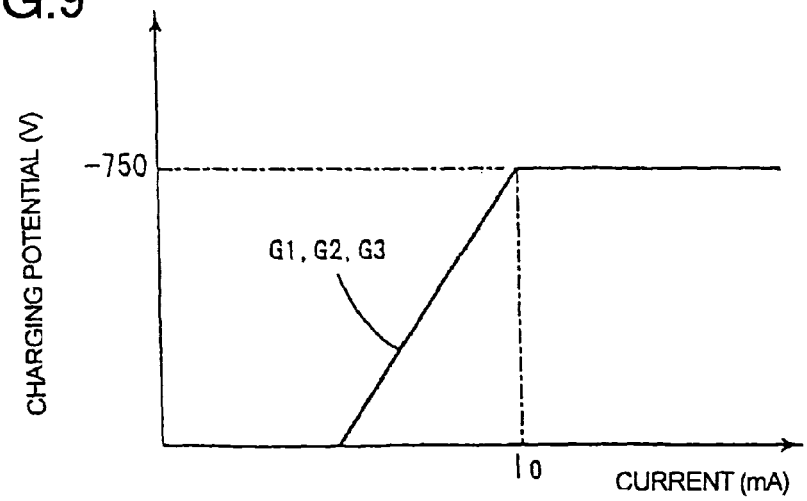
FIG. 9 is a graph of current supplied to the charger against the charging potential of the charger.

In the present embodiment, in application of AC component, when AC voltage that is subjected to constant current control is superimposed on DC voltage that is subjected to constant voltage control, current that is supplied to the charger 2 and the charging potential on the surface of the image carrier have almost a uniform relationship irrespective of variation in the gap (indicated by reference numerals G1, G2, and G3 in FIG. 9). If the current is greater than or equal to I0, the electric potential on the surface of the image carrier is maintained at a uniform value. The matching of the uniform value with the constant DC voltage that is applied on the charger 2 is taken into consideration. Peak-to-peak voltage obtained at target current value that is equivalent to a saturation current value greater than or equal to the current value I0, is detected while detecting the current that is supplied to the charger 2 when a certain peak-to-peak voltage is applied to AC voltage. Assuming a feed back control in which the peak-to-peak voltage is applied on the AC voltage, the target value current that is used for the control is adjusted in accordance with the absolute humidity.

That is, the target value of current is divided in 5 stages according to the absolute humidity as indicated in Table 3.

TABLE 3

| Absolute humidity (%) | Target current (mA) |
|---|---|
| H < 5 | 1.01 |
| 5 ≦ H < 10 | 0.98 |
| 10 ≦ H < 15 | 0.96 |
| 15 ≦ H < 20 | 0.94 |
| 20 ≦ H | 0.93 |

In the present embodiment, by adjusting the target value of current during detection of the peak-to-peak voltage in accordance with the absolute humidity, insufficient application of bias of DC voltage due to variation in environment like temperature and humidity is eliminated. Further, if there is a difference in either of resistance and gap for different lots, the charging characteristics between two different lots can be made uniform.

The inventor of the present invention carried out image formation by passing 20,000 papers without using correction in accordance with the absolute humidity and with conditions in the present embodiment and compared the two. When the correction was not carried out, the toner filming did not appear on the image but was observed on the image carrier. When correction was carried out, there was no toner filming on the image carrier.

In the present embodiment, it is possible to carry out the correction control not only for the absolute humidity as indicated in Table 3, but also for temperature in addition to the absolute humidity.

TABLE 4

| Temperature T (° C.) | Absolute humidity H (%) | Target value of current (mA) |
|---|---|---|
| T < 20 | H < 5 | 1.01 |
| T < 20 | 5 ≦ H < 10 | 0.98 |
| T < 20 | 10 ≦ H | 0.97 |
| 20 ≦ T < 25 | H < 5 | 0.99 |
| 20 ≦ T < 25 | 5 ≦ H < 10 | 0.96 |
| 20 ≦ T < 25 | 10 ≦ H | 0.95 |
| 25 ≦ T | H < 5 | 0.97 |
| 25 ≦ T | 5 ≦ H < 10 | 0.95 |
| 25 ≦ T | 10 ≦ H < 15 | 0.94 |
| 25 ≦ T | 15 ≦ H < 20 | 0.94 |
| 25 ≦ T | 20 ≦ H | 0.94 |

Thus, it is possible to maintain the charging characteristics throughout, irrespective of the variation in the environment by adjusting minutely the bias conditions of AC voltage rather than just carrying out correction in accordance with the absolute moisture.

In the present embodiment, it is assumed that the feed back control and the correction of bias conditions for a set of prescribed number of papers is carried out. However, to carry out the correction of the bias conditions in accordance with the variation in the minute gap that occurs due to variation in environment like temperature and humidity, is a necessary condition to maintain uniform charging characteristics. Therefore, in the present embodiment, it is also possible to carry out the correction when the variation in the temperature and the humidity is beyond prescribed level.

Moreover, the correction can be carried out for a period of time during which the temperature and humidity tend to vary considerably. That is, when the image forming apparatus starts operating, units in the apparatus, which are in stopped condition so far, start operating, due to which the temperature and humidity tend to vary. Particularly, the starting of operation of the fixing unit raises the temperature inside the image forming apparatus. Therefore, the relative humidity and temperature vary, thereby dropping the resistance of the charger 2 as indicated in FIG. 6. Due to the drop in the resistance, the AC voltage on which the peak-to-peak voltage is applied rises excessively thereby hastening the fatigue of the image carrier. Besides, due to initial draft of the power pack, the output to the power pack tend to delay slightly by prescribed time after the power supply is put ON. Therefore, in the present embodiment, till the annulment of this instability, i.e. after passing of prescribed time only after putting the power supply ON, the correction control is carried out once again. Thus, it is possible to improve an accuracy of the correction control by annulling the instability.

According to the present invention, when a charging bias is applied by superimposing an AC voltage on a DC voltage to carry out discharge in a minute gap, the AC voltage is corrected in accordance with an absolute humidity. Therefore, even when the minute gap varies due to a variation in the environment, bias conditions of the AC voltage corresponding to the variation are obtained, thereby enabling to prevent a variation in charging characteristics.

Moreover, even if the electric resistance of a charger varies due to variations in the environment conditions, a correction of bias in accordance with a temperature and a humidity is possible. Therefore, a variation in charging characteristics can be prevented satisfactorily.

Furthermore, a control unit carries out control of AC voltage in accordance with a value of DC current detected in a charging unit. The control unit can vary a target value for control in accordance with a temperature and humidity. Therefore, even if the electric resistance varies due to a difference in accuracy of each product in different lots, it is possible to carry out a feed back control of a target value for control of an electric resistance for each lot. It is also possible to uniform charging characteristics of a latent image carrier in a lot by changing the target value for control in accordance with temperature and humidity. Thus, charging unevenness in the latent image carrier can be prohibited.

Moreover, a bias correction of AC voltage is carried out if the environment conditions vary beyond a prescribed level. Therefore, it is possible to maintain desirable charging characteristics throughout by a correction that is required to be carried out from time to time.

Furthermore, a bias correction is carried out in accordance with a variation in an environment and a variation in an output immediately after a power supply to an apparatus is put ON. Therefore, it is possible to maintain desirable charging characteristics throughout right from a start up, thereby preventing a charging unevenness in a latent image carrier.

Moreover, a correction control of AC voltage is carried out. Therefore, it is possible to prevent variation in an apparatus, which cannot be recognized only by variation in environment conditions. For example, a variation in charging characteristics due to contamination etc. of a charger can be prevented.

Furthermore, a control of a bias change is carried out outside an image forming section (area) of an image. Therefore, there is no bias variation in an image area and it is possible to stabilize charging characteristics while reducing noise (defective image having horizontal lines) in the image.

Moreover, even if the charging roller is made of an elastic material of medium resistance, it is possible to stabilize charging characteristics in accordance with environment conditions by reducing variation in charging characteristics that is caused due to influence of temperature. Thus, it is possible to prevent charging unevenness in the latent image carrier.

The present document incorporates by reference the entire contents of Japanese priority document, 2002-223687 filed in Japan on Jul. 31, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a charger that charges a body with a voltage in which an AC voltage is superimposed on an DC voltage, wherein the charger is not in contact with the body;

a humidity detecting unit that detects a humidity in a space between the charger and the body;

a correcting unit that decides a magnitude of the AC voltage to be superimposed on the DC voltage based on the humidity;

a current detecting unit that detects direct current; and a control unit that varies the magnitude of the AC voltage in accordance with the current detected and the humidity.

2. The image forming apparatus according to claim 1, wherein the control unit varies the magnitude of the AC voltage if a change in the humidity exceeds a predetermined value.

3. The image forming apparatus according to claim 1, wherein the control unit varies the magnitude of the AC voltage after elapsing of prescribed time upon a power supply to the control unit is turned ON.

4. The image forming apparatus according to claim 1, wherein the control unit varies the magnitude of the AC voltage upon passage of prescribed number of papers.

5. The image forming apparatus according to claim 1, wherein the control unit carries out bias change of the AC voltage and sets the bias to a fixed value during image forming either of when an area corresponding to a non-image area on a latent image carrier is charged and when a charging bias is not applied.

6. The image forming apparatus according to claim 1, wherein the charger is a roller that includes a material having a medium electric resistance.

7. The image forming apparatus according to claim 1, wherein the control unit changes bias of the AC voltage by a feed back control in accordance with the humidity.

8. An image forming apparatus comprising:

a charger that charges a body with a voltage in which an AC voltage is superimposed on an DC voltage, wherein the charger is not in contact with the body;

a humidity detecting unit that detects a humidity in a space between the charger and the body;

a temperature detecting unit that detects a temperature in the space between the charger and the body;

a correcting unit that decides a magnitude of the AC voltage to be superimposed on the DC voltage based on at least one of the humidity and the temperature;

a current detecting unit that detects direct current; and a control unit that varies the magnitude of the AC voltage in accordance with the current detected and the humidity and the temperature.

9. The image forming apparatus according to claim 8, wherein the control unit varies the magnitude of the AC voltage if a change in any one of the humidity and the temperature exceeds a predetermined value.

10. The image forming apparatus according to claim 8, wherein the control unit varies the magnitude of the AC voltage after elapsing of prescribed time upon a power supply to the control unit is turned ON.

11. The image forming apparatus according to claim 8, wherein the control unit varies the magnitude of the AC voltage upon passage of prescribed number of papers.

12. The image forming apparatus according to claim 8, wherein the control unit carries out bias change of the AC voltage and sets the bias to a fixed value during image forming either of when an area corresponding to a non-image area on a latent image carrier is charged and when a charging bias is not applied.

13. The image forming apparatus according to claim 8, wherein the charger is a roller that includes a material having a medium electric resistance.

14. The image forming apparatus according to claim 8, wherein the control unit changes bias of the AC voltage by a feed back control in accordance with any one of the humidity and the temperature.

15. A method of forming image comprising:

detecting a humidity in a space between a charger and a body, wherein the charger charges the body with a voltage in which an AC voltage is superimposed on an DC voltage;

deciding a magnitude of the AC voltage to be superimposed on the DC voltage based on the humidity;

detecting a direct current; and varying the magnitude of the AC voltage in accordance with the current detected and the humidity.

16. The method according to claim 15, wherein the varying includes varying the magnitude of the AC voltage if a change in the humidity exceeds a predetermined value.

17. The method according to claim 15, wherein the varying includes varying the magnitude of the AC voltage after elapsing of prescribed time upon a power supply to the control unit is turned ON.

18. The method according to claim 15, wherein the varying includes varying the magnitude of the AC voltage passage of a prescribed number of papers.

19. The method according to claim 15, wherein the varying includes varying changing a bias of the AC voltage and setting of a bias to a fixed value during image formation either of when an area corresponding to a non-image area on a latent image carrier is charged and when a charging bias is not applied.

20. The method according to claim 15, wherein the changing of the bias of the AC voltage includes performing feed back control in accordance with the humidity.

21. A method of forming image comprising:

detecting a humidity and a temperature in a space between a charger and a body, wherein the charger charges the body with a voltage in which an AC voltage is superimposed on an DC voltage;

deciding a magnitude of the AC voltage to be superimposed on the DC voltage based on at least one of the humidity and the temperature;

detecting a direct current; and varying the magnitude of the AC voltage in accordance with the current detected and the humidity.

22. The method according to claim 21, wherein the varying includes varying the magnitude of the AC voltage if a change in the humidity exceeds a predetermined value.

23. The method according to claim 21, wherein the varying includes varying the magnitude of the AC voltage after elapsing of prescribed time upon a power supply to the control unit is turned ON.

24. The method according to claim 1, wherein the varying includes varying the magnitude of the AC voltage upon passage of a prescribed number of papers.

25. The method according to claim 1, wherein the varying includes varying changing a bias of the AC voltage and setting of a bias to a fixed value during image formation either of when an area corresponding to a non-image area on a latent image carrier is charged and when a charging bias is not applied.

26. The method according to claim 1, wherein the changing of the bias of the AC voltage includes performing feed back control in accordance with the humidity.

* * * * *